United States Patent [19]
Lüdemann et al.
[11] 4,290,594
[45] Sep. 22, 1981

[54] APPARATUS FOR STACKING SECTIONS OF DEVELOPED PHOTOGRAPHIC FILMS OR THE LIKE

[75] Inventors: Heinz Lüdemann; Franz Ziegler, both of Munich, Fed. Rep. of Germany

[73] Assignee: Agfa-Gevaert AG, Leverkusen, Fed. Rep. of Germany

[21] Appl. No.: 89,970

[22] Filed: Oct. 31, 1979

[30] Foreign Application Priority Data

Nov. 3, 1978 [DE] Fed. Rep. of Germany ..... 2847774

[51] Int. Cl.[3] ..... B65H 29/44
[52] U.S. Cl. ..... 271/180; 271/240
[58] Field of Search ..... 271/177, 180, 181, 188, 271/209, 240

[56] References Cited

U.S. PATENT DOCUMENTS

| | | | |
|---|---|---|---|
| 3,135,509 | 6/1964 | Zweig | 271/188 |
| 3,406,966 | 10/1968 | Walton | 271/180 X |
| 3,655,186 | 4/1972 | Bayha | 271/180 |
| 3,804,266 | 4/1974 | Furthmann | 271/180 X |
| 3,977,669 | 8/1976 | Douno | 271/180 |

FOREIGN PATENT DOCUMENTS

| | | | |
|---|---|---|---|
| 669787 | 1/1939 | Fed. Rep. of Germany | 271/181 |

*Primary Examiner*—Richard A. Schacher
*Attorney, Agent, or Firm*—Peter K. Kontler

[57] ABSTRACT

Apparatus for stacking sections of photographic films on top of each other in an elongated receptacle having a bottom panel and two side walls flanking an open top of the receptacle has two guide rails which are mounted on springs supported by the side walls and allowing each guide rail to pivot relative to the corresponding side wall. The guide rails have normally coplanar grooves for the marginal portions of a section which is supplied by a conveyor so that it overlies the open top of the receptacle. Two pivotable hold-down devices are mounted on the receptacle, and each hold-down device has a cushioned arm which is normally located at a level above the common plane of the two grooves. When a strip has been inserted into the grooves, the hold-down devices are pivoted to move their cushioned arms between the two guide rails and into the receptacle whereby the cushioned arms pivot the guide rails and simultaneously expel the marginal portions of the strip between the guide rails from the respective grooves so that the strip enters the receptacle. Retainers are provided on the side walls to prevent stacked strips which exhibit a pronounced tendency to curl from rising into the space between the grooves of the guide rails.

18 Claims, 4 Drawing Figures

APPARATUS FOR STACKING SECTIONS OF DEVELOPED PHOTOGRAPHIC FILMS OR THE LIKE

BACKGROUND OF THE INVENTION

The present invention relates to improvements in apparatus for manipulating sections of flexible webs or the like, especially for stacking sections of exposed and developed photograhic customer films. More particularly, the invention relates to improvements in apparatus for accumulating successively delivered sections of photographic customer films or the like in a receptacle wherein the successively delivered sections overlie each other.

It is already known to stack photographic prints in an apparatus wherein successive prints are deposited on the wings of two rotating paddle wheels. When a print comes to rest on two registering wings, the paddle wheels are caused to rotate in opposite directions and thus to deposit the print onto a platform. At the same time, the next-following wings of the paddle wheels are moved to optimum positions for reception of the next-following print. The just described stacking apparatus is normally installed immediately downstream of a severing device which subdivides a series of coherent paper prints into discrete prints. The stacked prints are thereupon inserted into envelopes and returned or shipped to or picked up by dealers or customers. The foremost print which issues from the severing device is caused to automatically advance onto the two registering wings of the paddle wheels, and the severing device or a detector thereupon transmits a signal which causes the paddle wheels to turn, normally through 90 degrees, so as to deposit the foremost print onto the growing stack. A drawback of the just described stacking apparatus is that, even though it can rapidly assemble a stack of paper prints, it is less suited for the stacking of sections of photographic films because the films normally exhibit a strong tendency to curl. Moreover, the tendency to curl often varies from film to film, so that the apparatus may be capable of properly stacking sections of a first film but cannot perform the same function in connection with the next-following film or films. If the tendency of a film to curl is very pronounced, the sections on the wings of the paddle wheels tend to bulge upwardly and prevent rotation of the paddle wheels in directions to deposit the film section thereon in the receptacle therebelow. Moreover, the strips which are already stacked on top of each other are likely to prevent the deposition of an oncoming strip, so that such oncoming strip can be deformed or even destroyed. Apparatus of the just described character are disclosed in the commonly owned German Offenlegungsschrift No. 2,614,038 and in the corresponding U.S. patent application Ser. No. 906,606 filed by Bruno Regele on May 16, 1978.

An apparatus which serves to stack sections of photographic films is disclosed in German Offenlegungsschrift No. 2,553,612.3. In this apparatus, the strips are introduced into discrete compartments of a gathering device. All strips which belong to a given customer order are expelled from their compartments in a single step and are advanced toward or directly inserted into an envelope or another suitable receptacle. Such apparatus are quite satisfactory for manipulation of film sections; however, the controls which regulate the admission of sections into the compartments and the expulsion of stacked sections from the compartments are rather complex and expensive. A similar apparatus is described and shown in commonly owned U.S. Pat. No. 4,154,046 granted to Klaus Weber et al. on May 15, 1979.

OBJECTS AND SUMMARY OF THE INVENTION

An object of the invention is to provide a novel and improved apparatus for gathering sections which constitute or form part of elongated flexible webs or strips, especially for stacking sections of exposed and developed customer films preparatory to returning of such strips to the customers.

Another object of the invention is to provide an apparatus which can properly stack sections of films or the like regardless of whether the sections exhibit a strong or minor tendency to curl or roll.

A further object of the invention is to provide an apparatus which can stack sections of exposed and developed photographic films at the rate at which the sections are formed by a device which subdivides successive films into sections of desired length, e.g., into sections each of which includes four or six film frames.

An additional object of the invention is to provide the apparatus with novel and improved means for preventing stacked sections from interfering with the addition of further sections.

Another object of the invention is to provide the apparatus with novel and improved means for guiding the sections during transport to positions of registry with the previously deposited or stacked sections.

A further object of the invention is to provide an apparatus which is simpler and more reliable than heretofore known apparatus and which can be installed in photographic processing laboratories as a superior substitute for heretofore known stacking apparatus.

Still another object of the invention is to provide an apparatus which, even though especially suited for gathering of sections of exposed and developed photographic films, can be used with equal advantage for stacking of other types of strip- or web-shaped material, such as photographic prints, cards, sheets and/or others.

One feature of the invention resides in the provision of an apparatus for stacking flexible strips, e.g., sections of exposed and developed photographic films. The apparatus comprises a receptacle having an open side (such open side may constitute the upper side of a receptacle which includes a bottom panel and two substantially parallel side walls at least one of which is adjustable toward and away from the other side wall to conform the width of the receptacle to different widths of strips to be temporarily stored and stacked therein), and a transfer mechanism having a pair of guide members which flank the open side of the receptacle and at least one of which is movable (preferably pivotable or tiltable) relative to the receptacle so as to enable a flexible strip whose longitudinally extending marginal portions are engaged by the guide members to advance between the guide members and enter the receptacle by moving through the open side of the receptacle. The transfer mechanism further comprises one or more helical or leaf springs or other suitable means for yieldably biasing the one guide member to a predetermined or starting position in which the one guide member is ready to be engaged by an oncoming strip, and means for moving the one guide member against the opposition of the biasing means. Such moving means comprises one or more hold-down devices or pushers which are movable from retracted positions outside of the receptacle to second positions between the guide members and in the interior of the receptacle to thereby transfer a strip from the guide members into the receptacle during movement from the retracted to the second position. Still further, the apparatus comprises a conveyor or other suitable means for feeding discrete sections seriatim into engagement with the guide members in the retracted positions of the hold-down devices. The guide members can be formed with grooves which receive the respective marginal portions of a freshly admitted strip and from which the marginal portions are expelled in response to movement of the hold-down device or devices from the retracted to the second position or positions.

The novel features which are considered as characteristic of the invention are set forth in particular in the appended claims. The improved apparatus itself, however, both as to its construction and its mode operation, together with additional features and advantages thereof, will be best understood upon perusal of the following detailed description of certain specific embodiments with reference to the accompanying drawing.

Figure 1:
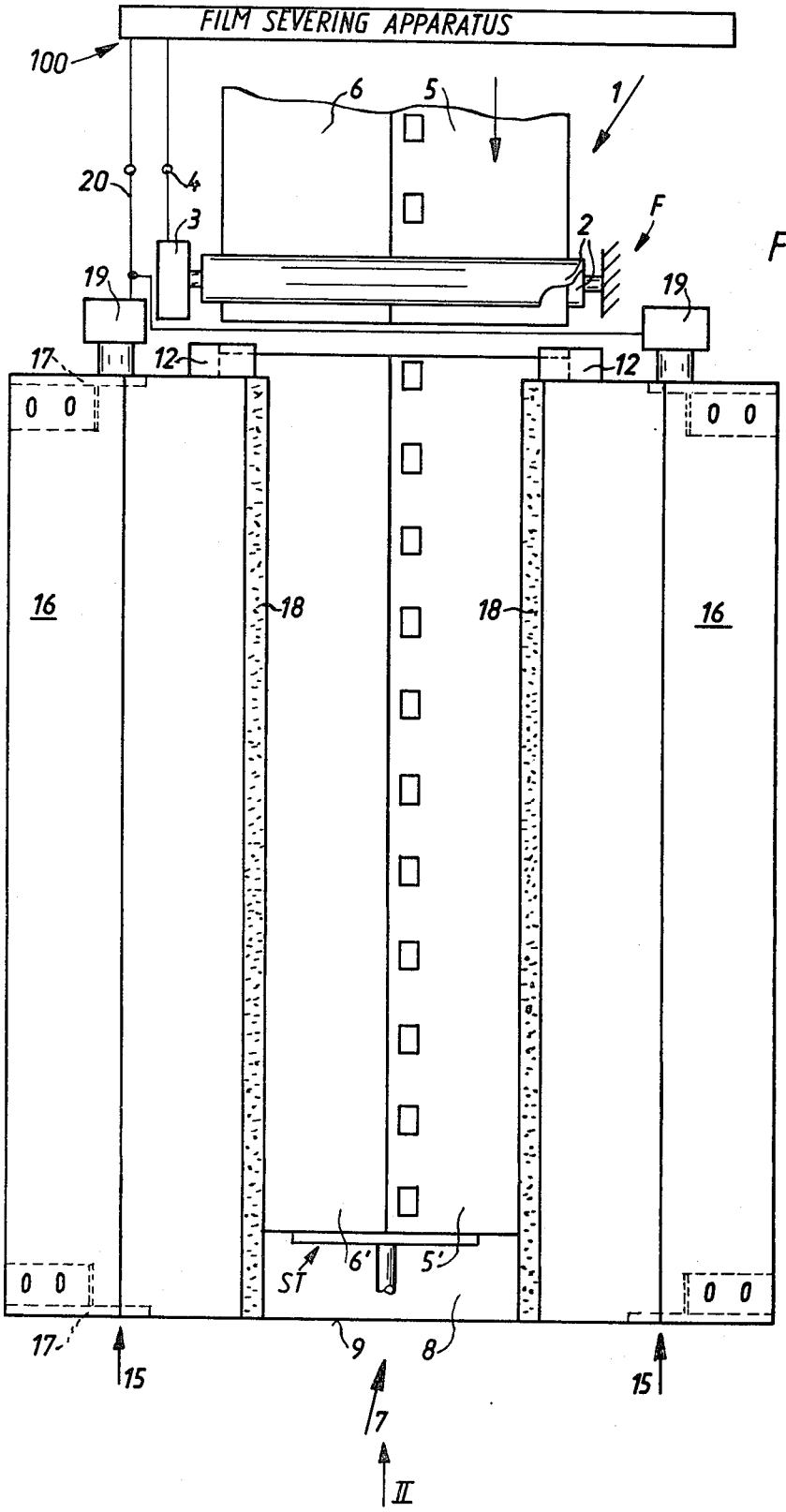
FIG. 1 is a schematic plan view of an apparatus which embodies the invention and is used to accumulate stacks of sections of flexible webs or strips.

FIG. *2a* is an end elevational view of the apparatus, as seen in the direction of arrow II of FIG. 1, and shows a section of a web of photographic film immediately after introduction into the grooves of the guide members;

FIG. *2b* illustrates the structure of FIG. *2a*, with the freshly introduced section in the process of being transferred into the receptacle which accumulates the stack; and FIG. *2c* illustrates the structure of FIG. *2a*, with the freshly introduced section located on top of the previously deposited section.

DESCRIPTION OF THE PREFERRED EMBODIMENTS

Referring first to FIG. 1, the apparatus which is shown therein comprises a frame or main support F which is assumed to be located downstream of a conventional severing apparatus 100 for exposed and developed photographic customer films. Such films are normally subdivided into sections of desired length (for example, each section may consist of four or six coherent film frames) which are to be stacked on top of each other prior to introduction into envelopes. The envelopes also receive prints (if any) and are thereupon picked up by the customers or dealers or are delivered or shipped to dealers for shipment to or for pickup by customers. The severing apparatus 100 (whose details form no part of the present invention) is located above the stacking apparatus, as viewed in FIG. 1. The apparatus 100 supplies a freshly severed film section or strip 5 (which may but need not be attached to a paper strip 6) to the nip of two advancing rolls 2 forming part of a conveyor or feeding means 1 which delivers successive sections into the stacking apparatus, namely, above a receptacle or repository 8 for stacked sections 5, 5', 5'', etc. The motor 3 for the advancing rolls 2 of the conveyor 1 receives signals via conductor means 4. For example, the conductor means 4 can transmit a signal to start the motor 3 whenever the knife or knives of the apparatus 100 sever a customer film to separate a discrete section from the leading end thereof.

The stacking apparatus further comprises a transfer mechanism 7 which is installed at a leval above the receptacle 8 and serves to accept successive flexible sections from the conveyor 1 and to deposit such sections in the receptacle so that the sections are neatly stacked on top of each other. The receptacle 8 comprises a bottom wall or panel 9 and two adjustable side walls 10 which are movable in directions indicated by double-headed arrows 11 (see FIG. *2a*). The purpose of adjustable side walls 10 is to enable an attendant to rapidly convert the apparatus for stacking of relatively narrow, wider or very wide sections of photographic films or the like. The side walls 10 are parallel to each other and may constitute elongated strips or blocks extending at right angles to the axes of the advancing rolls 2. As indicated by the arrows 11, the side walls 10 are movable toward and away from each other to change the width of the compartment wherein the film sections are stacked. The range of adjustment of the side walls 10 can be sufficient to enable the apparatus to stack film sections (such as 5, 5', 5'', etc.) with or without paper strips (6, 6', 6'', etc.). FIGS. *2a–2c* show that the side walls 10 flank an open side (i.e., the open top) of the receptacle 8.

The transfer mechanism 7 is mounted, at least in part, on the side walls 10 and comprises two elongated guide members or rails 12 carried by sets of helical springs 13 which allow the guide rails to assume several positions of different inclination (compare FIGS. *2a* and *2c* with FIG. *2b*). The springs 13 are directly or indirectly supported by the respective side walls 10. Those (inner) edge faces of the guide rails 12 which face each other are formed with longitudinally extending grooves 14 for the marginal portions of successive sections (as shown in FIGS. *2a–2c*, each such section includes a strip of photographic film and a strip of paper which adheres to the respective film strip). The depth of the grooves 14 is such that, when the guide rails 12 assume the normal or predetermined positions of FIG. *2a* or *2c*, i.e., when the two grooves are located in a common plane, a section (e.g., that including the strips 5 and 6) can readily advance therein with minimal friction. The springs 13 allow the respective guide rails 12 to turn through at least 45 degrees, i.e., to move between the normal position shown in FIGS. *2a* and *2c* in which the two grooves 14 are located in a common plane and the positions shown in FIG. *2b* in which the planes of the two grooves are inclined downwardly toward the compartment between the side walls 10 of the receptacle 8.

The side walls 10 further support discrete hold-down devices or pushers 15 which serve to expel sections from the grooves 14 and to introduce the thus expelled sections into the receptacle 8, i.e., to deposit each next-following section (such as 5, 6) on top of the previously deposited section (5', 6'). Each hold-down device or pusher 15 comprises a substantially L-shaped portion 16 one arm of which is mounted between two bearing brackets 17 for pivotal movement about an axis (see the pins *16a*) which is parallel to the longitudinal extensions of the side walls 10 and guide rails 12, and the other arm of which carries a cushion 18 to reduce the likelihood of damage to the sections which are to be transferred into the compartment between the side walls 10. It is clear that the brackets 17 can be mounted on the bottom panel 9 or on stationary parts adjacent to the receptacle 8. The length of each cushion 18 preferably equals or approximates the length of a section (such as 5, 6), and these cushions are parallel to the grooves 14 of the guide rails 12. The hold-down devices 15 are movable (pivotable) between the retracted positions of FIG. *2a* in which the cushions 18 are disposed at a level slightly above the path of a section (5, 6) whose marginal portions advance in the grooves 14, intermediate positions which are shown in FIG. *2b* and in which the cushions cause at least some inclination of the guide rails 12 so that the median portion of a section 5, 6 between these guide rails bulges downwardly and the springs 13 store energy, and the fully extended positions which are shown in FIG. *2c* and in which the cushions 18 cause the freshly transferred section 5, 6 to rest upon and to lie flat or substantially flat against the section (5', 6') therebelow. Thus, the devices 15 can move their respective cushions 18 between the end positions of FIG. *2a* in which the cushions are spaced apart from the path of movement of a section toward the position of overlap with the previously deposited section, and the end positions of FIG. *2c* in which the cushions 18 are close to the upper side of the bottom panel 9 of the receptacle 8. The drive means 19 for pivoting the hold-down devices 15 between the just described end positions receive signals via conductor means 20 shown in FIG. 1. The conductor means 20 transmits signals which are generated by the severing apparatus 100, i.e., by the apparatus preceding the just described stacking apparatus.

The operation of the improved stacking apparatus is as follows:

It is assumed that the compartment above the bottom panel 9 of the receptacle 8 contains a partially assembled stack including a single (lowermost) section 5'', 6''. The apparatus is in the process of depositing a second section 5', 6' which is already located beyond the range of the advancing rolls 2 and whose marginal portions extend into the respective grooves 14 (see FIGS. 1 and *2a*). The leader of the next-following section 5, 6 extends through the nip of the advancing rolls 2 and this section is ready to advance above the receptacle 8 as soon as the motor 3 receives a signal via conductor means 4. Such signal is transmitted when the section 5', 6' is already transferred into the compartment between the side walls 10 and the guide rails 12 assume their normal positions in which the two grooves 14 are located in a common plane, namely, in the plane of the leader of the section 5, 6. It is preferred to select or adjust the motor 3 in such a way that the advancing rolls 2 can propel the sections above the receptacle 8 at a speed which suffices to advance the trailing end of the thus propelled section beyond the nip of the rolls 2. To this end, the apparatus preferably comprises a braking device or a stop (shown at ST in FIG. 1) which arrests a freshly conveyed section in an optimum position for transfer into the compartment between the side walls 10. In other words, the nip of the rolls 2 is free to receive the leader of the next-following section as soon as the preceding section reaches the stop ST.

When the leading edge of the section 5', 6' whose marginal portions extend into the grooves 14 reaches the stop ST, the conductor means 20 transmits a signal to the motors 19 which pivot the respective hold-down devices 15 from the retracted positions of FIG. *2a* to the intermediate positions of FIG. *2b*. The intermediate positions of FIG. *2b* are or can be selected in such a way that the angle which the planes of the grooves 14 make with a horizontal plane is approximately 30 degrees, i.e., approximately two-thirds of the minimum angle at which the marginal portions of a section are actually expelled from the grooves 14. When the hold-down devices 15 assume the positions of FIG. *2b*, the cushions 18 engage the rear side of the section 5', 6' close to the respective grooves 14 and cause the central portion of the section 5', 6' to bulge downwardly, i.e., toward the interior of the receptacle 8. The inclination of the guide rails 12 changes (from the positions of FIG. *2a* to the positions shown in FIG. *2b*) under the action of the cushions 18, i.e., the stiffness of the section 5', 6' suffices to effect a deformation of the springs 13, especially since the cushions 18 engage the rear side of the section 5', 6' rather close to the open ends of the respective grooves 14. A comparison of FIG. *2a* with FIG. *2b* will reveal that the cushions 18 effect partial expulsion of the marginal portions of the section 5', 6' from the respective grooves 14 when the guide rails 12 assume the inclined positions of FIG. *2b;* nevertheless, the guide rails 12 continue to engage the adjacent outermost parts of such marginal portions.

The motors 19 continue to pivot the respective hold-down devices 15 in opposite directions whereby the cushions 18 descend further toward the bottom panel 9 and expel the marginal portions of the section 5', 6' from the respective grooves 14. The final or inner end positions of the cushions 18 are shown in FIG. *2c*. It will be noted that the section 5', 6' overlies the section 5'', 6'' and is close to the upper side of the bottom panel 9. The sections 5', 6' and 5'', 6'' accurately overlap each other if the width of the compartment between the side walls 10 is selected in such a way that it only slightly exceeds the width of a section. Additional contributions to accurate register of overlapping sections are made by the stop ST and by the cushions 18 of the two hold-down devices 15.

The springs 13 are free to return the guide rails 12 to the normal positions (shown in FIGS. *2a* and *2c*) as soon as the cushions 18 expel the marginal portions of the section 5', 6' from the respective grooves 14. Thus, the grooves 14 are then located in a common plane which is also the plane of the leader of the section 5, 6 between the advancing rolls 2 of the conveyor 1. The motors 19 thereupon return the hold-down devices 15 to the retracted positions of FIG. *1a*, so that the rolls 2 can advance the next section 5, 6 above the receptacle 8. This takes place in response to transmission of a signal via conductor means 4, so that the motor 3 is started in order to advance the section 5, 6 downwardly, as viewed in FIG. 1. The motors 19 for the hold-down devices 15 may constitute or comprise rotary electromagnets which, when energized pivot respective hold-down devices 15 from the positions of FIG. *2a* to the positions shown in FIG. *2c*. Suitable springs are provided to return automatically the hold-down devices 15 to the positions of FIG. *2a* as soon as the respective electromagnets are deenergized.

Figure 2A:
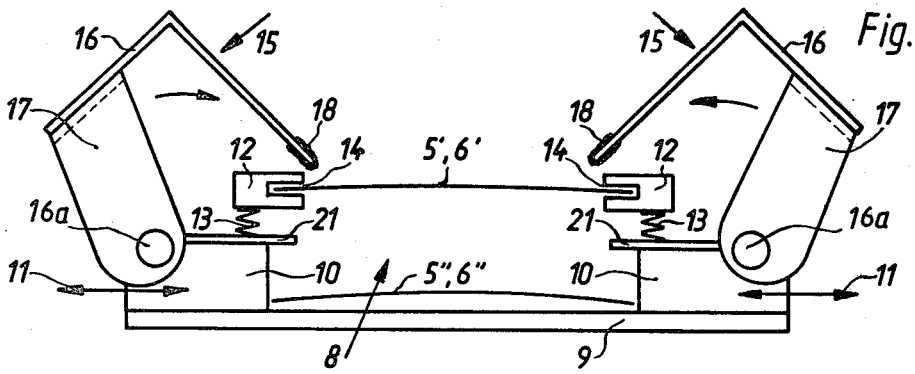
Figure 2B:
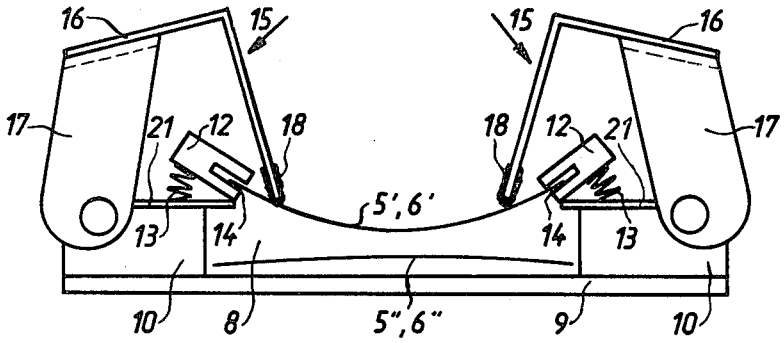
Figure 2C:
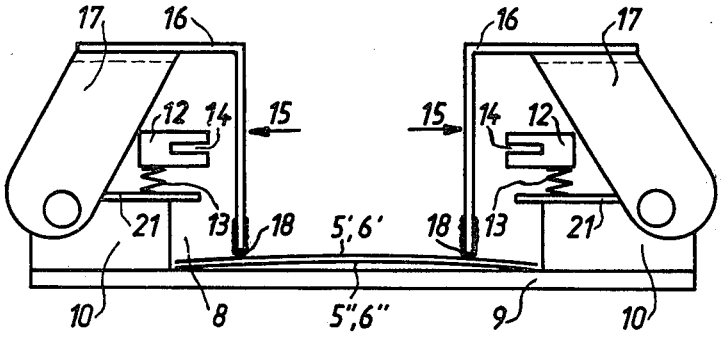

In accordance with an additional feature of the invention, the apparatus comprises projections or retainers 21 which may consist of sheet metal or a suitable synthetic plastic material and serve to prevent the deposited section from interfering with the introduction of additional section. As shown, the retainers 21 extend inwardly beyond the side walls 10 so as to overlie the respective edges of the compartment above the bottom panel 9. The inner edges of the retainers 21 are preferably flush with the inner edge faces of the guid rails 12 thereabove. These retainers can serve the additional purpose of limiting the extent of pivotal movement of the guide rails 12 in response to movement of cushions 18 into the compartment between the side walls 10. Even though FIG. 2*b* shows that the guide rails 12 abut against the respective retainers 21, the marginal portions of the sections 5', 6' can be readily expelled from the respective grooves 14 because such marginal portions simply slide out of the grooves in response to further downward movement of the cushions 18, even if the retainers 21 prevent further pivoting of the associated guide rails 12 against the opposition of the corresponding springs 13. The provision of retainers 21 constitutes an optional but highly desirable feature of the improved apparatus. As a rule, such retainers will be necessary (for the purpose of preventing excessive bulging of the uppermost section in the receptacle 8) only if the sections exhibit a highly pronounced tendency to curl. Thus, in many instances, the retainers 21 will serve solely as a means for limiting the extent of pivotal movement of the corresponding guide rails 12. The retainers 21 determine the width of the open side (i.e., open top) of the receptacle 8.

An important advantage of the improved apparatus is that even a film section which exhibits a highly pronounced tendency to curl cannot interfere with proper introduction of the next-following section into the receptacle 8. Moreover, a preceding section cannot interfere with lengthwise movement of the next-following section to an optimum position above the receptacle 8, i.e., each section can reach the stop ST regardless of the tendency of the preceding section or sections in the receptacle to roll, curl or undergo other types of deformation.

Another important advantage of the improved apparatus is that it allows for rapid accumulation of stacks of sections of photographic films or other flexible webs or strips. The stacks are neat and the number of sections in a stack can be selected practically at will. Still further, the components of the apparatus are compact, rugged and perform simple movements which can be readily synchronized. The number of motors is small and the controls for the motors are simple.

The apparatus which is illustrated in the drawing is susceptible of many modifications without departing from the spirit of the invention. For example, the two hold-down devices or pushers 15 can be replaced with a single hold-down device or pusher whose cushion engages the upper side of a section above the receptacle 8 substantially midway between the guide rails 12. Alternatively, the apparatus may comprise more than two (e.g., two pairs of) hold-down devices. Still further, the length of the hold-down devices need not match or even approximate the length of the guide rails 12. A single hold-down device can be used when the receptacle 8 is relatively deep or when the sections exhibit little or no tendency to curl.

It is further possible to provide the apparatus with means for automatically expelling stacks of overlapping sections from the receptacle 8. For example, such expelling means may comprise a plunger which penetrates into one end of the compartment between the side walls 10 and expels the stack through the other end of such compartment in response to a signal which denotes completion of transfer of the last of a series of film sections belonging to a particular customer. The plunger can enter the compartment below the rolls 2 to expel the stacks downwardly, as viewed in FIG. 1. This would necessitate retraction of the stop ST if the latter extends well into the space between the side walls 10.

It is also possible to replace the one and/or the other set of helical springs 13 with other types of means for yieldably biasing the guide rails 12 to their normal positions. For example, the illustrated helical springs can be replaced with suitable leaf springs. All such modifications will be readily understood without further illustrations upon perusal of the preceding description.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for stacking flexible strips, such as sections of photographic films, comprising a receptacle having an open side; a transfer mechanism including a pair of guide members flanking the open side of said receptacle, at least one of said guide members being movable relative to said receptacle so as to enable a flexible strip whose marginal portions are engaged by said guide members to advance between said guide members and into said receptacle, elastically yieldable means for biasing said one guide member to a predetermined position in which said one guide member is ready to be engaged by an oncoming strip, and means for moving said one guide member relative to said receptacle against the opposition of said biasing means, including at least one pusher movable from a retracted position to a second position between said guide members and into said receptacle to thereby transfer a strip from the guide members into the receptacle; and means for feeding sections seriatim into engagement with said guide members in the retracted position of said pusher.

2. The apparatus of claim 1, wherein each of said guide members is movable relative to said receptacle and further comprising means for biasing the other of said guide members to a predetermined position in which said other guide member is ready to be engaged by an oncoming strip.

3. The apparatus of claim 1, wherein said guide members have grooves which are substantially coplanar in said predetermined positions of said guide members, said feeding means being arranged to introduce the marginal portions of successive strips into the respective grooves and said pusher being operative to expel such marginal portions from the respective grooves in response to movement to said second position.

4. The apparatus of claim 3, wherein said biasing means comprises at least one spring.

5. The apparatus of claim 1, wherein said receptacle comprises a pair of side walls supporting the respective guide members and the biasing means for said one guide member.

6. The apparatus of claim 5, wherein at least one of said side walls is movable toward and away from the other side wall to thereby vary the width of said receptacle so as to conform to the width of strips to be stacked therein.

7. The apparatus of claim 1, further comprising retainer means arranged to maintain the strips in said receptacle.

8. The apparatus of claim 7, wherein said receptacle comprises a pair of side walls flanking said open side and said retainer means comprises projections mounted on said side walls and extending toward each other so that a strip which is caused to enter the receptacle by moving between and beyond said projections and exhibits a tendency to leave the receptacle via said open side abuts against said projections.

9. The apparatus of claim 1, further comprising means for limiting the extent of movement of said one guide member relative to said receptacle.

10. The apparatus of claim 9, wherein said limiting means comprises retainer means mounted on said receptacle and including projections which determine the width of said open side.

11. The apparatus of claim 1, wherein said transfer mechanism comprises two pushers each of which is adjacent to a different one of said guide members and is movable past such guide member and into the receptacle to thereby disengage the adjacent marginal portion of a strip from the respective guide member while simultaneously introducing such strip into said receptacle.

12. The apparatus of claim 11, wherein said guide members are elongated parallel rails and said pushers are pivotable about axes which are parallel to said rails.

13. The apparatus of claim 12, wherein said receptacle includes a bottom panel and two substantially parallel side walls flanking said open side, said pushers being closely adjacent to said bottom panel in said second positions thereof.

14. The apparatus of claim 13, wherein each of said guide members has an elongated groove for the respective marginal portion of a strip which is delivered by said feeding means, said grooves being coplanar in said predetermined position of said one guide member and said pushers being disposed at one side of the common plane of said grooves in said retracted positions of said pushers and extending to the other side of said plane in said second positions thereof.

15. The apparatus of claim 1, wherein said pusher includes a substantially L-shaped portion having first and second arms, means for pivoting said portion by way of one of said arms and an elastic strip-engaging cushion provided on the other of said arms.

16. The apparatus of claim 15, wherein said pivoting means includes a rotary electromagnet.

17. The apparatus of claim 1, further comprising means for supplying strips to said feeding means and means for transmitting signals from said supplying means to said feeding means, said feeding means being operative to advance a strip into engagement with said guide members in response to a signal from said supplying means.

18. The apparatus of claim 17, wherein said pusher includes motor means and further comprising means for transmitting signals from said supplying means to said motor means so as to actuate said pusher when a strip is engaged by said guide members.

* * * * *